US006096958A

United States Patent [19]

Liao

[11] Patent Number: 6,096,958

[45] Date of Patent: Aug. 1, 2000

[54] TRANSMISSION MECHANISM FOR A HI-HAT CYMBAL

[75] Inventor: Tsun-Chi Liao, Taichung, Taiwan

[73] Assignee: Hwa-Shin Musical Instrument Co., Ltd., Taichung, Taiwan

[21] Appl. No.: 09/265,968

[22] Filed: Mar. 11, 1999

[51] Int. Cl.[7] ..... G10D 13/02

[52] U.S. Cl. ..... 84/422.3; 84/422.1; 84/422.2

[58] Field of Search ..... 84/421, 422.1, 84/422.2, 422.3

[56] References Cited

U.S. PATENT DOCUMENTS

| | | | |
|---|---|---|---|
| 5,388,495 | 2/1995 | Atsumi | 84/422.3 |
| 5,415,072 | 5/1995 | Huang | 84/422.3 |
| 5,646,360 | 7/1997 | Liao | 84/422.1 |
| 5,756,912 | 5/1998 | Liao | 84/421 |
| 6,011,207 | 1/2000 | Hoshino | 84/422.1 |

*Primary Examiner*—Stanley J. Witkowski
*Assistant Examiner*—Kim Lockett
*Attorney, Agent, or Firm*—Bacon & Thomas, PLLC

[57] ABSTRACT

A transmission mechanism mounted on a rack and driven by a foot pedal to move a movable center rod and a superior cymbal at said movable center rod relative to a fixed inferior cymbal, the transmission mechanism including an oscillating member, which has a horizontal block connected to the foot pedal by a chain and a vertical block, a first universal joint connected between the vertical block of the oscillating member and the movable center rod, a second universal joint securely mounted on the rack at a bottom side, and a coupling bolt turned about a pivot pin at the vertical block of the oscillating member and securely connected to the second universal joint.

6 Claims, 6 Drawing Sheets

TRANSMISSION MECHANISM FOR A HI-HAT CYMBAL

BACKGROUND OF THE INVENTION

The present invention relates to a hi-hat cymbal, and more specifically to a transmission mechanism coupled between the foot plate and the movable center rod in a hi-hat cymbal for moving a superior cymbal relative to an inferior cymbal.

A regular hi-hat cymbal, as shown in FIG. 1, comprises a stand, a vertical tube mounted on the stand at the center, an inferior cymbal securely fastened to the vertical tube at the top, a movable center rod inserted through the vertical tube, a superior cymbal fixedly mounted on the movable center rod and moved with the movable center rod relative to the inferior cymbal, a rack, a bottom plate connected to the rack, a foot pedal hinged to the bottom plate, a chain connected between the free end of the foot pedal and a coupling rod at the bottom end of the movable center rod, and spring means mounted in the vertical tube and imparting an upward pressure to the movable center rod. When the foot pedal is depressed, the movable center rod is lowered, thereby causing the superior cymbal and the inferior cymbal to be struck together to make a clashing sound. When the movable center rod is lowered, the spring means in the vertical tube is simultaneously compressed. When the foot pedal is released from the foot, the spring means immediately pushes the movable center rod to its former position. This design has drawbacks. Because the spring means imparts an upward pressure to the movable center rod, the player must employ much effort to the foot pedal to conquer the spring force of the spring means. If the spring means is made relatively stronger, much effort should be employed to depress the foot pedal. If the spring means is made relatively weaker, it cannot quickly return the movable center rod after each down stroke of the movable center rod.

SUMMARY OF THE INVENTION

The present invention provides a transmission mechanism for a hi-hat cymbal which eliminates the aforesaid problem. The transmission mechanism comprises an oscillating member, which has a horizontal block connected to the foot pedal by a chain and a vertical block, a first universal joint connected between the vertical block of the oscillating member and the movable center rod, a second universal joint securely mounted on the rack at a bottom side, and a coupling bolt turned about a pivot pin at the vertical block of the oscillating member and securely connected to the second universal joint. This design enables the foot pedal to be depressed to lower the movable center rod with less effort. Because the oscillating member has three points respectively connected to the movable center rod through the first universal joint, the foot pedal through the chain, and the second universal joint through the coupling bolt, the oscillating member immediately returns to its former position to lift the movable center rod when the foot pedal is released from the foot.

DETAILED DESCRIPTION OF THE PREFERRED EMBODIMENT

Figure 1:
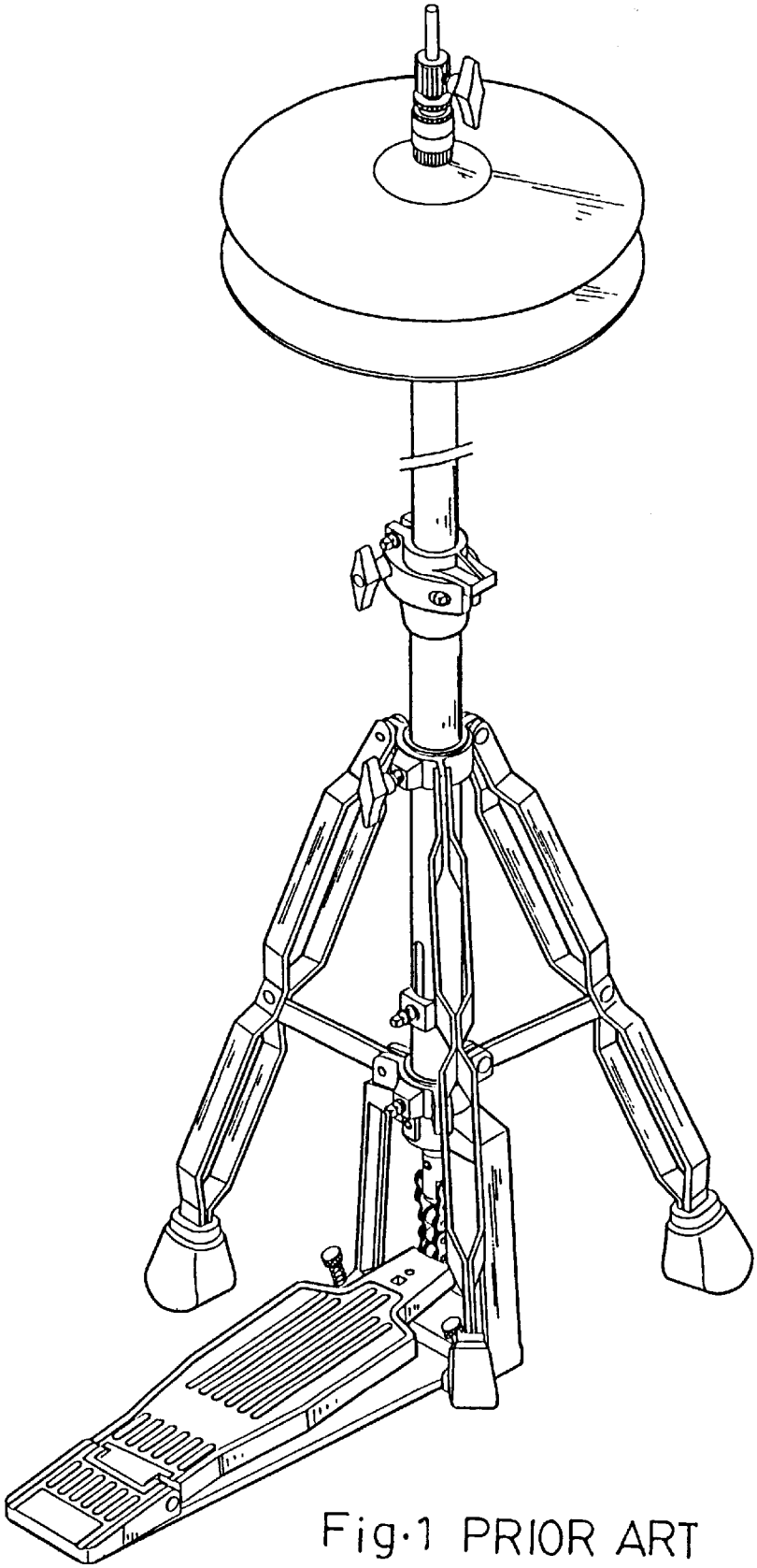
Fig·1 PRIOR ART
FIG. 1 is an elevational view of a conventional hi-hat cymbal according to the prior art.
Figure 2:
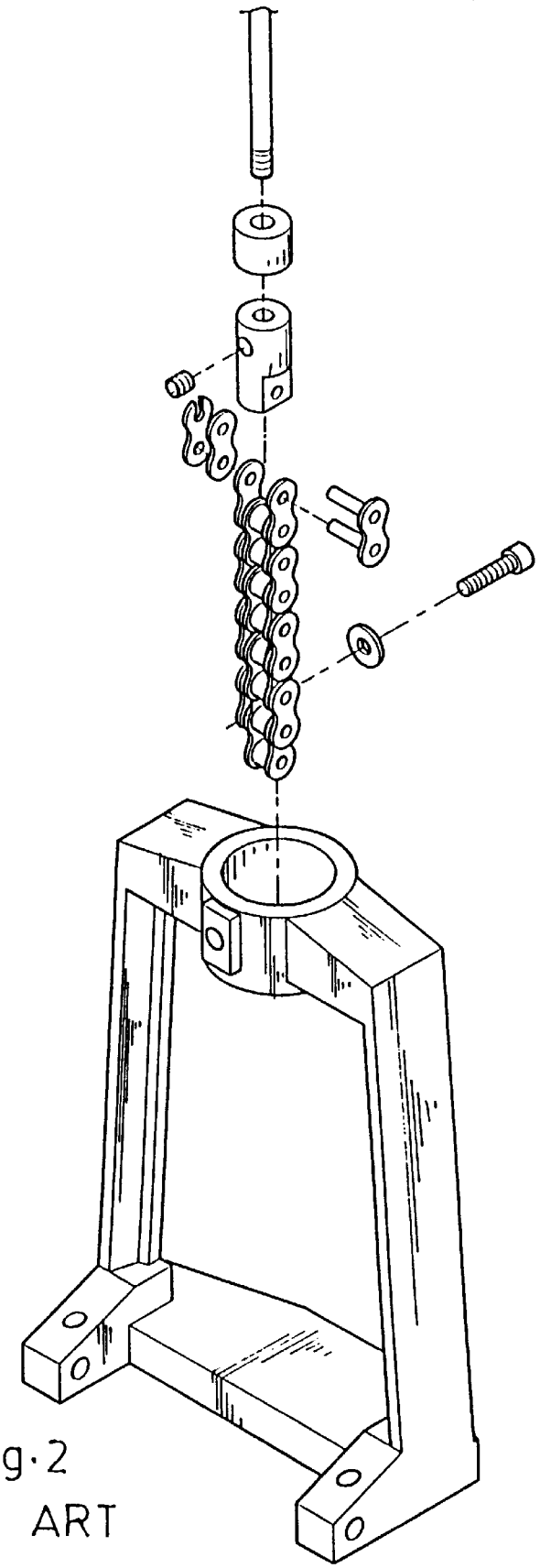
Fig. 2 PRIOR ART
FIG. 2 is an exploded view of the transmission mechanism used in the hi-hat cymbal shown in FIG. 1 according to the prior art.
Figures 3A, 3B:
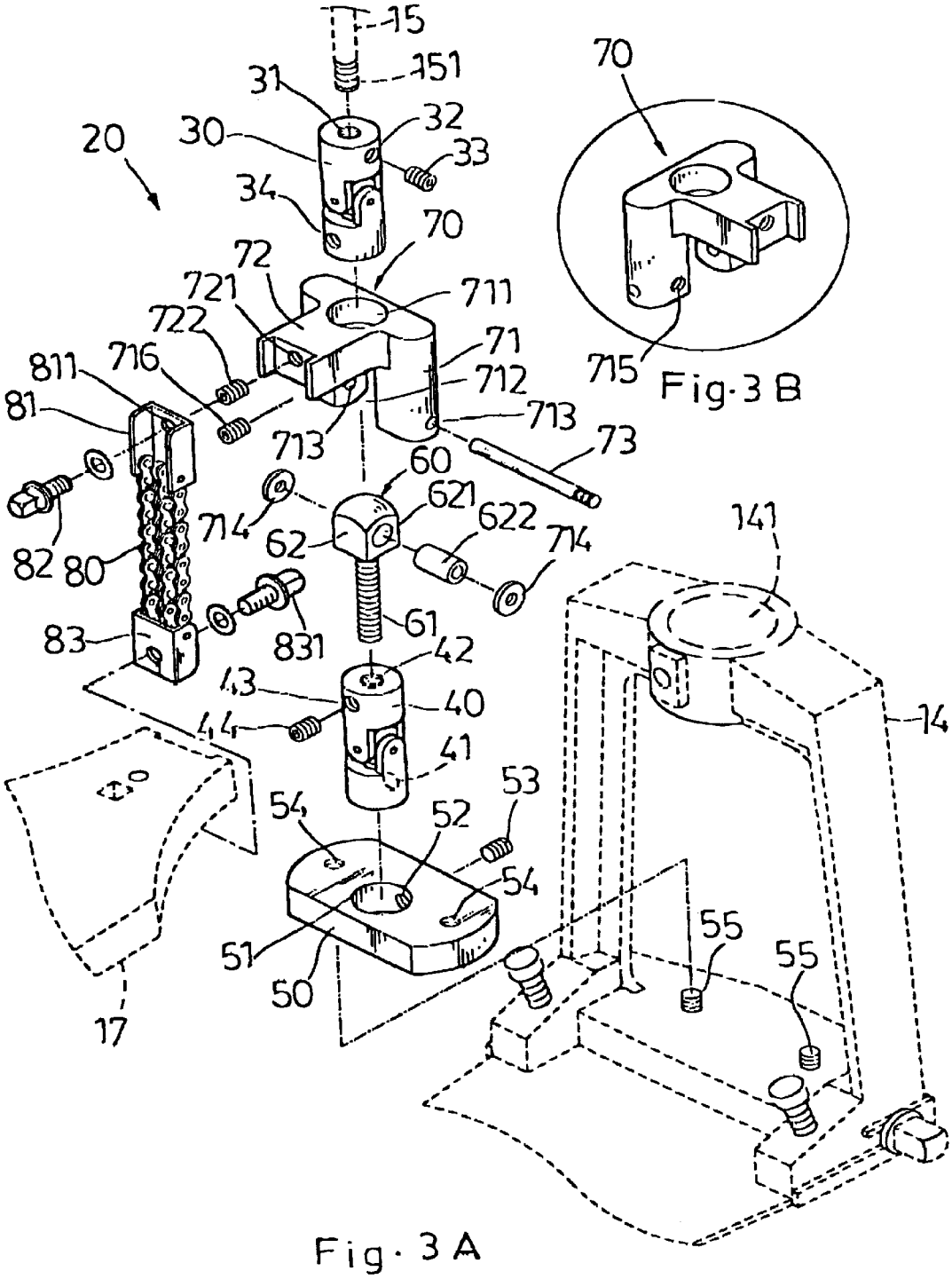
FIG. 3A is an exploded view of the present invention.
FIG. 3B is a perspective view of the oscillating member.
Figure 4:
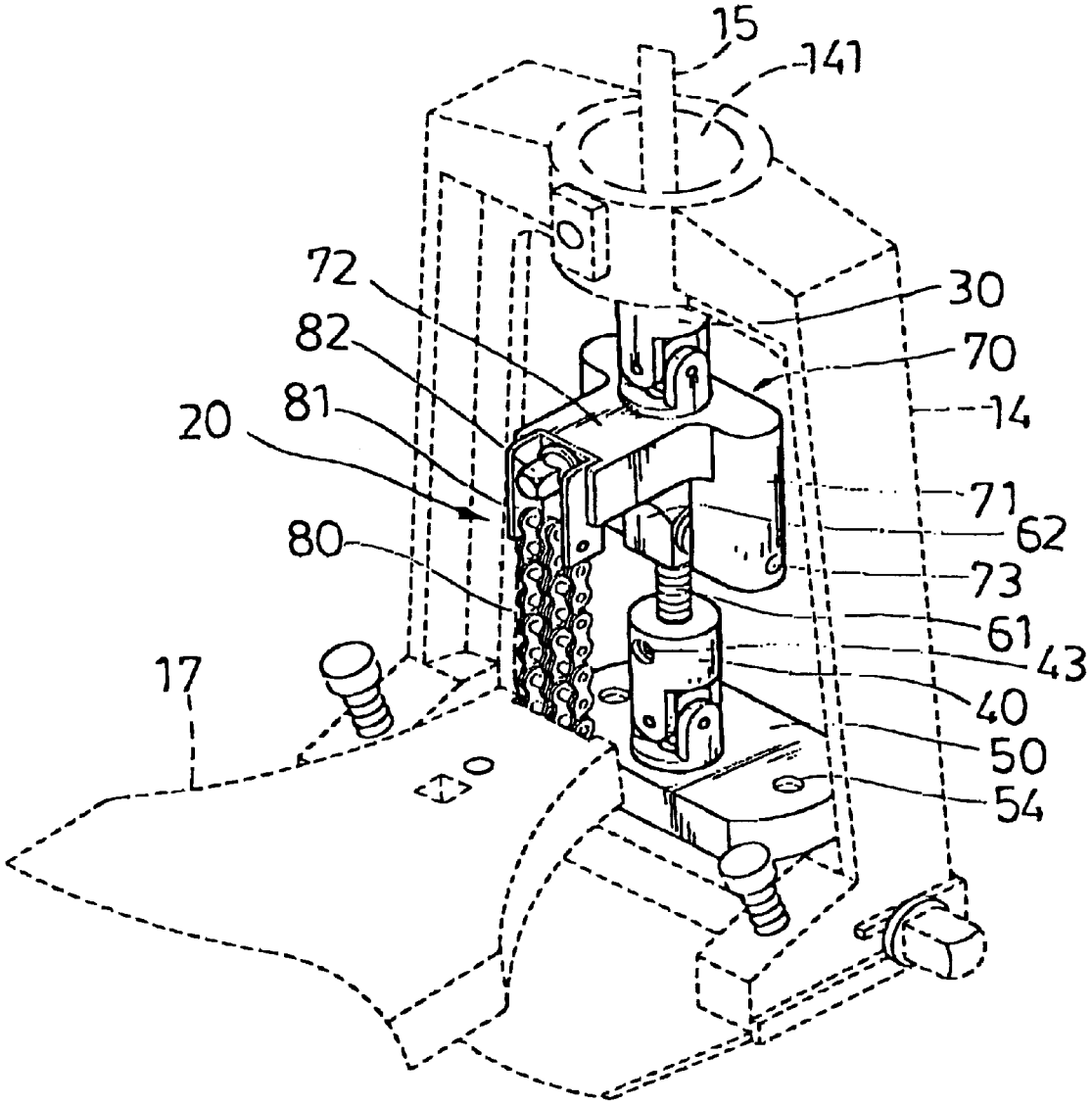
FIG. 4 shows an installed view of the present invention.

Referring to FIGS. 3A and 4, a rack 14 is shown having a vertical through hole 141 at the top. A movable center rod 15 is inserted through the through hole 141, and driven to move a superior cymbal (not shown) relative to an inferior cymbal (not shown). A transmission mechanism 20 is coupled between the bottom end of the movable center rod 15 and the free end of a hinged foot pedal 17. The transmission mechanism 20 comprises a first universal joint 30, a second universal joint 40, a locating block 50, a coupling bolt 60, an oscillating member 70, and a chain 80.

The first universal joint 30 comprises an axially extended screw hole 31 at its top end, which is threaded onto the threaded bottom end 151 of the movable center rod 15, a first radially extended screw hole 32 perpendicularly extended from the axially extended screw hole 31 to the periphery, a tightening up screw 33 threaded into the first radially extended screw hole 32 to fix the movable center rod 15 in place, and a second radially extended screw hole 34 near its bottom end.

The locating block 50 comprises a vertical locating hole 51 at the center, a screw hole 52 perpendicularly extended from the vertical locating hole 51 to the periphery, and two vertical mounting holes 54 spaced from the vertical locating hole 51 at two opposite sides fastened to the rack 14 at a bottom side by screws 55.

The coupling bolt 60 comprises a head 62 defining a transverse through hole 621, and a threaded stem 61 perpendicularly extended from the head 62. Further, an axle bush 622 is mounted in the transverse through hole 621.

The second universal joint 40 is inserted with its bottom end into the locating hole 51 at the center of the locating block 50, having an axially extended screw hole 42 at its top end, which is threaded onto the threaded shank 61 of the coupling bolt 60, a first radially extended screw hole 43 perpendicularly extended from the axially extended screw hole 42 to the periphery into which a tightening up screw 44 is threaded to fix the threaded shank 61 of the coupling bolt 60 in place, and a second radially extended screw hole 41 near its bottom end. A screw 53 is threaded into the screw hole 52 at the locating block 50 and the second radially extended screw hole 41 at the second universal joint 40 to secure the second universal joint 40 and the locating block 50 together.

The oscillating member 70 comprises a vertical block 71 and a horizontal block 72 connected at right angles. The vertical block 71 comprises a top through hole 711, which receives the bottom end of the first universal joint 30, a bottom opening 712, two transverse pin holes 713 axially aligned at two opposite sides of the bottom opening 712, and a transverse screw hole 715 perpendicularly extended from one pin hole 713 to the periphery. The horizontal block 72 comprises a screw hole 721 communicated with the top through hole 711. A screw rod 722 is threaded into the screw hole 721 at the horizontal block 72 and the second radially extended screw hole 34 at the first universal joint 30 to secure the first universal joint 30 and the oscillating member 70 together. A pin 73 is mounted in the transverse pin holes 713 and inserted through the axle bush 622. The pin 73 has at least one end embossed for positive positioning in the pin holes 713. A tightening up screw 716 is threaded into the screw hole 715 at the vertical block 71 to fix the pin 73 in place. Two washers 714 are mounted on the pin 73 between two opposite side walls of the head 62 and two opposite peripheral side walls of the bottom opening 712.

The chain 80 has first mounting frame 81 and a second mounting frame 83 at its two opposite ends. The first mounting frame 81 has a mounting hole 811 fastened to the screw hole 721 at the horizontal block 72 of the oscillating member 70 by a screw bolt 82. The second mounting frame 83 is fastened to the bottom side wall of the free end of the foot pedal 17 by a screw bolt 831.

Figure 5A:
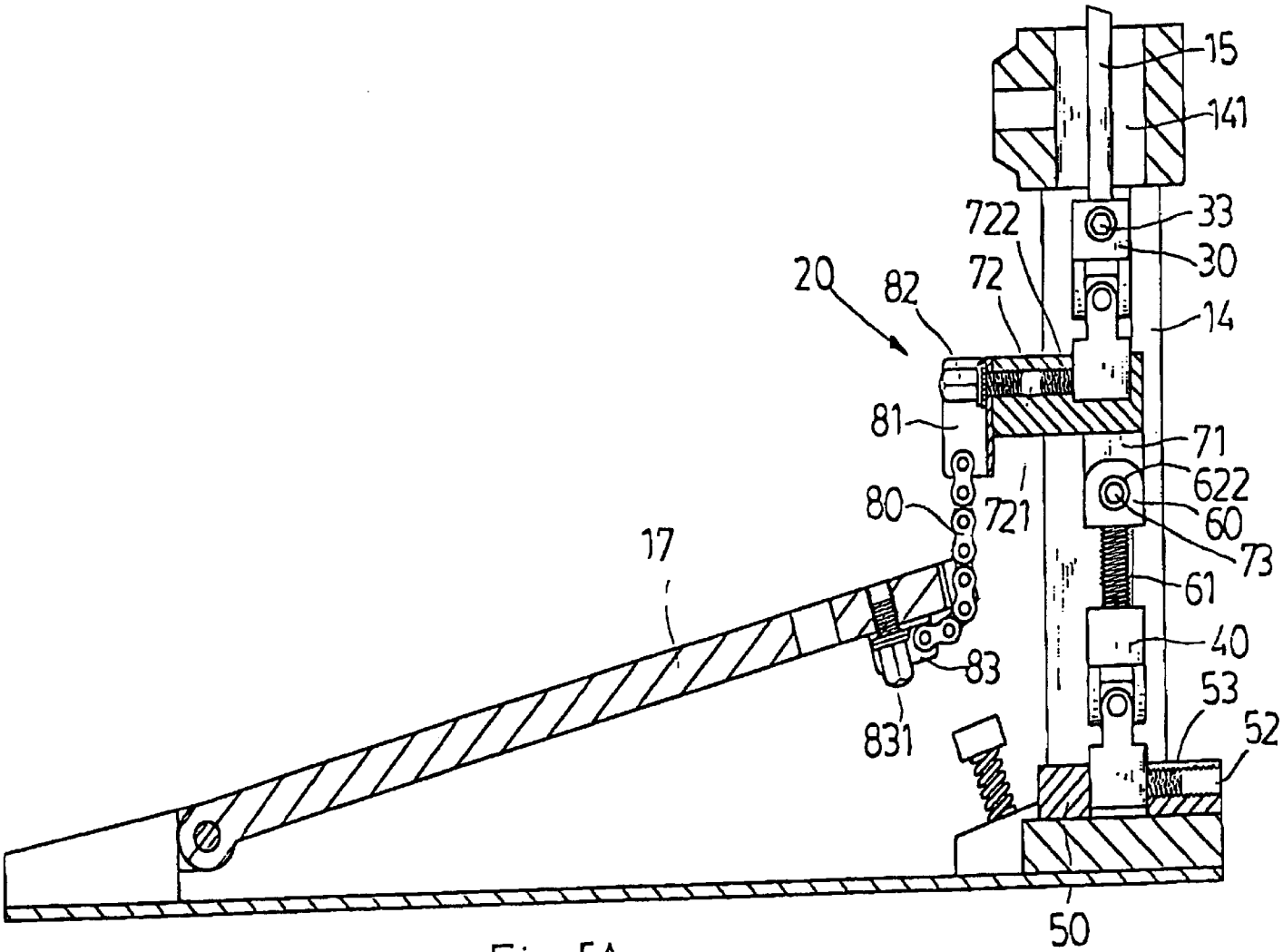
FIG. 5A is a sectional view of the present invention (the foot pedal released).
Figure 5B:
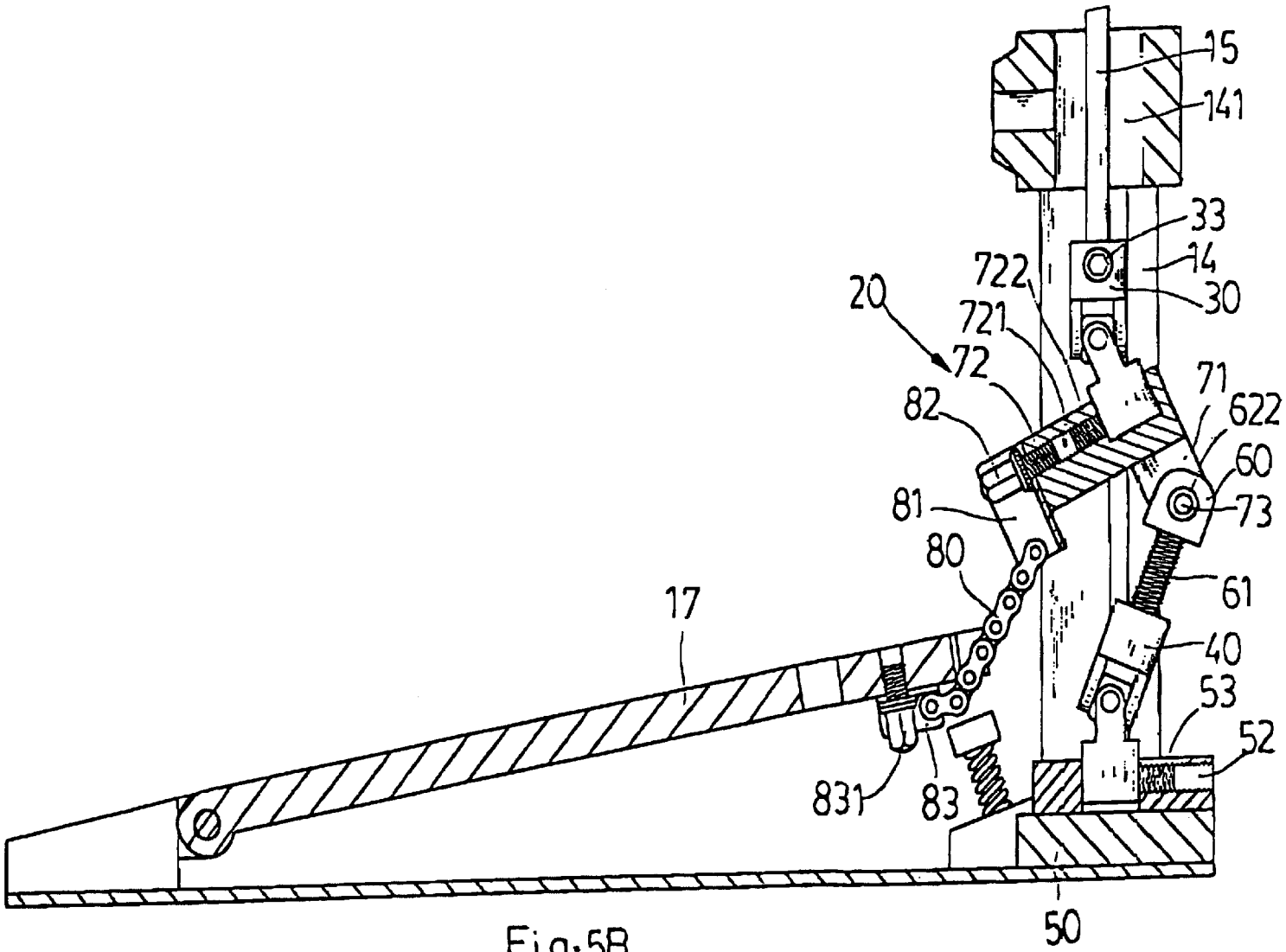
FIG. 5B is a sectional view of the present invention (the foot pedal depressed).

Referring to FIGS. 5A and 5B, when the hi-hat cymbal is not operated (see FIG. 5A), the oscillating member 70 is balanced to keep the horizontal block 72 in horizontal, the universal joints 30 and 40 and the coupling bolt 60 are vertically aligned in a line to hold the movable center rod 15 in the upper limit position where the superior cymbal is spaced above the inferior cymbal. When the foot pedal 17 is pressed down with the foot (see FIG. 5B), the oscillating member 70 is pulled downwards. Because the head 62 of the coupling bolt 60 is pivoted to the pin 73 and the threaded stem 61 of the coupling bolt 60 is secured to the top end of the second universal joint 40, pulling the oscillating member 70 downwards causes the coupling bolt 60 to be turned downwardly backwards, enabling the movable center rod 15 to be lowered with the oscillating member 70, and therefore the superior cymbal and the inferior cymbal are struck together to make a clashing sound. When the foot plate 17 is released from the foot, the downward drag force is released from the horizontal block 72 of the oscillating member 70, and the first universal joint 30 automatically returns to its former position, thereby causing the oscillating member 70 to be returned to the balanced condition, and therefore the movable center rod 15 is lifted to move the superior cymbal upwardly away from the inferior cymbal.

As indicated above, when the foot pedal 17 is pressed down with the foot, the movable center rod 15 is lowered, causing the superior cymbal and the inferior cymbal to be struck together to make a clashing sound. When the foot pedal 17 is released from the foot, the movable center rod 15 is quickly lifted to move the superior cymbal upwardly away from the inferior cymbal. During the operation of the hi-hat cymbal, the transmission mechanism 20 produces low noise.

What is claimed is:

1. A transmission mechanism mounted on a rack and driven by a foot pedal to move a movable center rod and a superior cymbal at said movable center rod relative to a fixed inferior cymbal, the transmission mechanism comprising:

a first universal joint, said first universal joint having a top end securely connected to said movable center rod and a bottom end;

a second universal joint, said second universal joint having a bottom end securely connected to said rack and spaced below said first universal joint, and a top end;

a coupling bolt, said coupling bolt comprising a head, and a threaded stem perpendicularly extended from said head and securely connected to the top end of said second universal joint, said head having a transverse through hole;

an oscillating member, said oscillating member comprising a vertical block and a horizontal block connected at right angles, said vertical block having a top side securely connected to the bottom end of said first universal joint, a bottom opening, two transverse pin holes axially aligned at two opposite sides of said bottom opening;

a pin mounted in the transverse pin holes at said vertical block of said oscillating member and inserted through the transverse through hole at the head of said coupling member; and a chain connected between said horizontal block of said oscillating member and said foot pedal.

2. The transmission mechanism of claim 1 wherein said first universal joint comprises an axially extended screw hole at the top end thereof, which is threaded onto a threaded bottom end of said movable center rod, a screw hole perpendicularly extended from the axially extended screw hole at said first universal joint, and a tightening up screw threaded into the screw hole at said first universal joint and stopped against the periphery of said movable center rod to fix said movable center rod in place.

3. The transmission mechanism of claim 1 wherein said second universal joint comprises an axially extended screw hole at the top end thereof, which is threaded onto the threaded shank of said coupling bolt, a screw hole perpendicularly extended from the axially extended screw hole at said second universal joint, and a tightening up screw threaded into the screw hole at said second universal joint to fix the threaded shank of said coupling bolt in place.

4. The transmission mechanism of claim 1 wherein said vertical block of said oscillating member comprises a top through hole, which receives the bottom end of said first universal joint, and said horizontal block of said oscillating member comprises a screw hole communicated with the top through hole at said vertical block through which a screw rod is threaded into a screw hole at the bottom end of said first universal joint to fix said first universal joint and said oscillating member together.

5. The transmission mechanism of claim 1 further comprising an axle bush sleeved onto said pin and mounted within the transverse through hole at the head of said coupling bolt.

6. The transmission mechanism of claim 1 wherein said pin has at least one end thereof embossed for positioning in the transverse pin holes at said vertical block of said oscillating member.

* * * * *